US005695899A

United States Patent [19]

Kamada et al.

[11] Patent Number: 5,695,899

[45] Date of Patent: Dec. 9, 1997

[54] COLORED TONER FOR DEVELOPING ELECTROSTATIC IMAGES

[75] Inventors: Hiroshi Kamada; Hitoshi Masuda, both of Chigasaki; Yukinobu Hasegawa, Uozu; Hiroyoshi Shimomura, Hiratsuka; Hiroshi Serizawa, Fujisawa; Kensuke Okuda, Ikeda; Masatoshi Maruyama, Hiratsuka, all of Japan

[73] Assignee: Nippon Carbide Kogyo Kabushiki Kaisha, Tokyo, Japan

[21] Appl. No.: 796,480

[22] Filed: Feb. 10, 1997

Related U.S. Application Data

[63] Continuation of Ser. No. 211,968, filed as PCT/JP92/01371, published as WO93/08510, Apr. 29, 1993, abandoned.

[30] Foreign Application Priority Data

Oct. 22, 1991 [JP] Japan ..... 3-301214
Oct. 29, 1991 [JP] Japan ..... 3-308237

[51] Int. Cl.[6] ..... G03G 9/083

[52] U.S. Cl. ..... 430/106; 430/110; 430/111

[58] Field of Search ..... 430/106, 110, 430/111

[56] References Cited

U.S. PATENT DOCUMENTS

| | | | |
|---|---|---|---|
| 3,615,749 | 10/1971 | Cramer et al. | 106/20 |
| 4,218,530 | 8/1980 | Lu | 430/107 |
| 4,378,419 | 3/1983 | Ciccarelli . | |
| 4,391,890 | 7/1983 | Lu . | |
| 4,397,935 | 8/1983 | Ciccarelli et al. . | |
| 4,411,974 | 10/1983 | Lu et al. . | |
| 4,415,646 | 11/1983 | Gruber et al. . | |
| 4,442,189 | 4/1984 | Lu et al. . | |
| 4,490,455 | 12/1984 | Hoffend et al. . | |
| 4,621,039 | 11/1986 | Ciccarelli et al. . | |
| 4,923,776 | 5/1990 | Hedvall et al. . | |
| 4,996,127 | 2/1991 | Hasegawa et al. | 430/109 |
| 5,093,201 | 3/1992 | Ohtani et al. . | |
| 5,118,588 | 6/1992 | Nair et al. | 430/110 |
| 5,166,029 | 11/1992 | Bayley et al. . | |
| 5,348,832 | 9/1994 | Sacripante et al. | 430/109 |

FOREIGN PATENT DOCUMENTS

| | | |
|---|---|---|
| 0185509 | 6/1986 | European Pat. Off. . |
| 0302939 | 2/1989 | European Pat. Off. . |
| 4990132 | 8/1974 | Japan . |
| 3121060 | 5/1988 | Japan . |
| 3186253 | 8/1988 | Japan . |
| 3282749 | 11/1988 | Japan . |

OTHER PUBLICATIONS

Okamoto Yoshinao, et al., Patent Abstracts of Japan, vol. 16, No. 80 (P-1318), 1992.

Yasuno Masahiro, et al., Patent Abstracts of Japan, vol. 13, No. 475 (P-950), 1989.

*Primary Examiner*—Hoa Van Le

*Attorney, Agent, or Firm*—Sherman and Shalloway

[57] ABSTRACT

A colored toner for developing electrostatic images which has a degree of gelation of 2.0% or less and comprises an association of secondary particles containing polymer particles having acidic polar groups or basic polar groups and an organic pigment and/or an organic dye treated with a treatment agent containing a surface treatment agent which has the same ionic character as the polymer particles so that the absolute value of ζ-potential becomes 10 to 100 mV at pH 5, and a developer for electrostatic images which comprises this colored toner and a carrier.

12 Claims, No Drawings

COLORED TONER FOR DEVELOPING ELECTROSTATIC IMAGES

DESCRIPTION

This application is a continuation of application Ser. No. 08/211,968, filed Apr. 21, 1994, now abandoned, application Ser. No. 08/211,968, entered the National Phase under 35 USC 371 via International Application PCT/JP92/01371, filed Oct. 21, 1992.

TECHNICAL FIELD

This invention relates to a colored toner for developing electrostatic images in electrophotography, electrostatic recording, electrostatic printing, etc.

BACKGROUND ART

Heretofore, toners used generally widely have been prepared by suitably dry blending a colorant such as carbon black, a charge control agent and/or a magnetic substance, with styrene/acrylate copolymer powder obtained by the suspension polymerization method; melting and kneading the blend by an extruder or the like; and then pulverizing and classifying the kneaded matter. (see Japanese Laid-Open Patent Publication No. 901332/1974).

However, as to toners obtained by such melting, kneading and pulverizing method, there have been problems that there is a limit in controlling the particle size of the toners, it is difficult to prepare the toners of a small particle size in good yields, and further the dispersion becomes ununiform and the charge quantity distribution becomes broad, and thus when the toners are used as a developer, the resolution is low and moreover it is impossible to avoid the drawbacks that fog and splash, etc. occur.

Further, when such toners are used as a full-colored toner and heat fixing is carried out, the coloring properties, etc. are bad, full-colored images based on the principle of superposition become indefinite, and further, color reproduction becomes bad, and when such toners are used in OHP, etc., the transmittance is bad and therefore definite images cannot be obtained.

This invention aims to provide a toner which has a high image density and a high resolution, and wherein fog, splash, etc. do not occur, and coloring properties, color reproduction, color transmittance when copying to OHP sheets was made, etc. are excellent.

DISCLOSURE OF INVENTION

This invention provides a colored toner for developing electrostatic images which has a degree of gelation of 2.0% or less and comprises an association of secondary particles containing polymer particles having acidic polar groups or basic polar groups and an organic pigment and/or an organic dye treated with a treatment agent containing a surface treatment agent which has the same ionic character as the polymer particles so that the absolute value of ζ-potential becomes 10 to 100 mV at pH 5.

In the toner of this invention, the shape factor S value of the toner particles is preferably 100.5 to 160.0.

Further, it is preferable that when the mean diameter of the toner particles obtained from the distance between circumscribed parallel lines is expressed as rm, the mean minimal value of the radius of curvature, on the surface of the toner particles, of each associated particle constituting the toner is expressed as rn, and V is assumed to be rm/rn, V, rm and rn can take the following values:

$1.01 \leqq V \leqq 320$ $2.5\ \mu m \leqq rm \leqq 16\ \mu m$ $0.05\ \mu m \leqq rn < rm$ Further, this invention provides a developer for electrostatic images which comprises the above colored toner for developing electrostatic images and a carrier.

Description is made below about the toner for developing electrostatic images of this invention.

The toner of this invention comprises associated particles which occurred by association of secondary particles composed of polymer particles having acidic or basic polar groups (hereafter these are sometimes referred to as primary particles) and an organic pigment and/or an organic dye treated specifically as later-described. In this connection, "association" means that plural secondary particles aggregate to form particles having a larger particle size.

A preferred example of the polymer having acidic polar groups or basic polar groups is a copolymer of a styrene, an alkyl (meth)acrylate and a comonomer having acidic polar groups or basic polar groups (hereafter referred to as "comonomer having polar groups").

A preferred specific examples of such copolymers is a copolymer comprising (a) 90 to 20 wt %, preferably 88 to 30 wt % of a styrene based on the total of (a) and (b), (b) 80 to 10 wt %, preferably 70 to 12 wt % of an alkyl (meth)acrylate based on the total of (a) and (b), and (c) when the total of (a) and (b) is assumed to be 100 weight parts, 0.05 to 30 weight parts, preferably 1 to 20 weight parts of the comonomer having polar groups.

Further, the above copolymer can freely contain a copolymerizable comonomer in an extent of not spoiling the performance of the toner of this invention, besides the monomers of (a), (b) and (c).

As the above styrenes, there can, for example, be mentioned styrene, n-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene, p-chloromethylstyrene, etc.

As the above alkyl (meth)acrylates, there can, for example, be mentioned methyl acrylate, ethyl acrylate, n-butyl acrylate, isobutyl acrylate, propyl acrylate, n-octyl, acrylate, dodecyl acrylate, lauryl acrylate, 2-ethylhexyl acrylate, stearyl acrylate, 2-chloroethyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, etc.

Among them, those wherein the carbon atom number of the ester portion is 1 to 12 are preferable, and those wherein the number is 3 to 8 are further preferable, and particularly, (meth)acrylic esters of aliphatic alcohols having 4 carbon atoms are used preferably.

As the above comonomers having acidic polar groups, there can, for example, be mentioned α,β-ethylenic unsaturated compounds having a carboxyl group and α,β-ethylenic unsaturated compounds having a sulfone group.

As the above α,β-ethylenic unsaturated compounds having a carboxyl group, there can, for example, be mentioned acrylic acid, methacrylic acid, fumaric acid, maleic acid, itaconic acid, cinnamic acid, maleic acid monobutyl ester, maleic acid monooctyl ester, and their metal salts such as sodium salts and zinc salts, etc.

As the above α,β-ethylenic unsaturated compounds having a sulfone group, there can, for example, be mentioned sulfonated ethylene, its Na salt, arylsulfosuccinic acid, octyl arylsuccinic acid and their Na salts.

As the above comonomers having a basic polar group, there can, for example, be mentioned (meth)acrylic esters which have an amine group or a quaternary ammonium group and wherein the carbon atom number of the ester portion is 1 to 12, preferably 2 to 8; (meth)acrylamide or (meth)acrylamides mono- or di-substituted by an alkyl group having 1 to 18 carbon atoms on optional N(s); vinyl compounds substituted by a heterocyclic group having N as a ring member; and N,N-diallyl-alkylamines or their quaternary ammonium salts. Among them, (meth)acrylic esters of aliphatic alcohols having an amine group or a quaternary ammonium group are preferably used as the comonomers having a basic polar group.

As the above (meth)acrylic esters of aliphatic alcohols having an amine group or a quaternary ammonium group, there can, for example, be mentioned dimethylaminoethyl acrylate, dimethylaminoethyl methacrylate, diethylaminoethyl acrylate, diethylaminoethyl methacrylate, their quaternary ammonium salts, 3-dimethylaminophenyl acrylate, 2-hydroxy-3-methacryloxypropyltrimethylammonium salts, etc.

As the above (meth)acrylamide or (meth)acrylamides mono- or di-substituted by an alkyl group having 1 to 18 carbon atoms on optional N(s), there can, for example, be mentioned acrylamide, N-butylacrylamide, N,N-dibutylacrylamide, piperidylacrylamide, methacrylamide, N-butylmethacrylamide, N,N-dimethylacrylamide, N-octadecylacrylamide, etc.

As the above vinyl compounds substituted by a heterocyclic group having N as a ring member, there can, for example, be mentioned vinylpyridine, vinylpyrrolidone, vinyl N-methylpyridinium chloride, vinyl N-ethylpyridinium chloride, etc.

As the above N,N-diallyl-alkylamines, there can, for example, be mentioned N,N-diallylmethylammonium chloride, N,N-diallylethylammonium chloride, etc.

The polymer particles of this invention can be obtained by polymerizing the above monomer composition by the emulsion polymerization method, the suspension polymerization method, the precipitation polymerization method or the interfacial polymerization method (including the coacervate method). It is also possible to mechanically pulverize synthetic resin pieces to give particles. Further, if necessary, it is also possible to use a method which comprises associating primary particles of the polymer utilizing the ζ-potential. Preferred methods for preparing polymer particles are the emulsion polymerization method, the suspension polymerization method and the method utilizing the ζ-potential.

The above polymer is used in a quantity of 40 to 99.9 wt % in the toner.

Further, the above polymer has a glass transition point of preferably −90° to 100° C., more preferably −30° to 80° C., still further preferably −10° to 70° C. When the glass transition point is above the above upper limit, there is a tendency that low temperature fixing properties become bad, and when it is under the above lower limit, there is a tendency that powder fluidity lowers.

The mean particle size of the primary particles of the above polymer is preferably 0.01 to 10 μm, more preferably 0.01 to 8 μm, still further preferably 0.01 to 5 μm, particularly preferably 0.01 to 3 μm.

When the toner is prepared using the later-described association method utilizing the ζ-potential, the ζ-potential of the particles of the above polymer desirably takes an appropriate value. It is preferable that the ζ-potential ($\zeta P_5$) in pH 5 of the acidic polar groups-containing polymer particles is −2 to −60 mV and the ζ-potential ($\zeta P_9$) in pH 9 thereof is −20 to −100 mV, and $\zeta P_5$ is larger than $\zeta P_9$.

Further, in the case of the basic polar groups-containing particles, it is desirable that $\zeta P_5$ of the polymer particles is +20 to +100 mV, $\zeta P_9$ thereof is +2.to +60 mV, and $\zeta P_5$ is larger than $\zeta P_9$.

The organic pigment and the organic dye used in this invention are those which were treated with a surface treatment agent having the same ionic character as the polymer particles used, and, as a result, wherein the absolute value of ζ-potential at pH 5 became 10 to 100 mV. It was found that by use of the thus treated organic pigment and/or organic dye, reaction between the polar groups in the polymer and the pigment or dye is inhibited, and as a result a colored toner having a degree of gelation of 2.0% or less may be obtained.

Although it is necessary for the surface treatment agent used to have the same ionic character as the polymer particles used, it causes no inconvenience that another kind of surface treatment agent is contained.

Since the absolute value of the ζ-potential at pH 5 is made to be 10 to 100 mV by the above treatment agent, a disperse dye which is used in such a state that the dye was dispersed in a medium is used as the organic dye used in this invention.

There is no particular limitation about the above organic pigment and organic dye used so long as they show coloring other than black, and it is also possible to combine one or two or more organic pigments and/or organic dyes, if necessary. Further, there is no hindrance if a metal is contained in these organic pigments and organic dyes.

As preferred examples of these organic pigments, the following ones can be mentioned.

(a) Azo pigments Hansa Yellow G, Benzidine Yellow, Benzidine Orange, Permanent Red 4R, Pyrazolone Red, Lithol Red, Brilliant Scarlet G, BON Maroon Light, etc.

(b) Acid dye pigments and basic dye pigments A pigment obtained by precipitating with a precipitating agent a dye such as Orange II, Acid Orange R, Eosine, Quinoline Yellow, Tartrazine Yellow, Acid Green, Peacock Blue or Alkali Blue; A pigment obtained by precipitating a dye such as Rhodamine, Magenta, Malachite Green, Methyl violet or Victoria Blue with tannic acid, tartar emetic PTA, PMA, PTMA or the like.

(c) Mordant dye pigments Metal salts of hydroxyanthraquinones, Alizarine Madder Lake, etc.

(d) Phthalocyanine pigments Phthalocyanine Blue, Sulfonated Copper Phthalocyanine, etc.

(e) Quinacridone pigments and Dioxane pigments Quinacridone Red, Quinacridone Violet, Carbazole Dioxazine Violet, etc.

In addition, organic fluorescent dyes, Aniline Black, etc.

Further, as the above organic dyes, there can be used Nigrosine dyes, Aniline dyes, etc.

Further, as specific suitable examples of the pigments and dyes, the following ones can be mentioned.

(1) Red pigments

C.I. Pigment Red
31, 57, 81, 84, 89, 112, 122, 123, 139, 144, 149, 166, 177, 178, 190, etc.

-continued

C.I. Pigment Violet
1, 19, 38, etc.

(2) Yellow pigments

C.I. Pigment Yellow
6, 12, 13, 14, 17, 83, 95, etc.

(3) Blue pigments

C.I. Pigment Blue
2, 3, 9, 14, 15, 16, 25, 60, 66, etc.

(4) Green pigments

C.I. Pigment Green
2, 7, 12, 36, 37, etc.

(5) Red dyes

C.I. Solvent Red
3, 16, 19, 24, 49, 52, 83, 125, 179, etc.
C.I. Solvent Violet
1, 21, etc.

(6) Yellow dyes

C.I. Solvent Yellow
2, 6, 14, 15, 16, 19, 21, 25, 60, 77, etc.
C.I. Solvent Orange
2, 7, 37, etc.
C.I. Disperse Yellow
242, etc.

(7) Blue dyes

C.I. Solvent Blue
4, 25, 40, 49, 55, 70, 83, 86, etc.
C.I. Disperse Blue
60, etc.

As examples of surface treatment agents for treating the pigments or dyes as described above, the following ones can be mentioned.

(1) Anionic surface active agents, dispersants

Mixed fatty acid sodium or potassium soaps, semi-hardened beef tallow fatty acid sodium or potassium soaps, sodium stearate soap, potassium oleate soap, castor oil potassium soap, lauryl sulfate sodium, potassium, ammonium or triethanolamine salt, sodium higher alcohol sulfate salts, sodium dodecylbenzenesulfonate, sodium or potassium alkylnaphthalenesulfonate, sodium or potassium dialkylsulfonesuccinate, sodium alkyl diphenyl ether disulfonate, sodium alkyl diphenyl ether disulfonate, alkyl phosphate diethanolamine salts or potassium salts, polyoxyethylene lauryl ether sulfate sodium or triethanolamine salts, polyoxyethylene alkylphenyl ether sulfate sodium salts, sodium alkanesulfonates, sodium salts of aromatic sulfonic acid-formalin condensates such as sodium salts of β-naphthalene sulfonic acid-formalin condensates, polycarboxylic acid type high molecular surface active agents, silicone surface active agents, fluorine surface active agents, etc.

(2) Nonionic surface active agents, dispersants

Polyoxyethylene lauryl ethers, polyoxyethylene cetyl ethers, polyoxyethylene stearyl ethers, polyoxyethylene oleyl ethers, polyoxyethylene higher alcohol ethers, polyoxyethylene octylphenyl ethers, polyoxyethylene nonylphenyl ethers, oxyethylene-oxypropylene block copolymers, sorbitan monolaurylate or monopalmitate or monostearate or tristearate or monooleate or trioleate or sesquioleate or distearate, polyoxyethylenesorbitan monolaurylate or monopalmitate or monostearate or tristearate or monooleate or trioleate or sesquioleate or distearate, silicone surface active agents, fluorine surface active agents, etc.

(3) Cationic surface active agents, dispersants

Tetraoleic acid polyoxyethylenesorbitol esters, coconut amine acetates, stearylamine acetate, coconut amine hydrochlorides, stearylamine hydrochloride, stearylamine oleate, lauryltrimethylammonium chloride, stearyltrimethylammonium chloride, distearyldimethylammonium chloride, alkylbenzyldimethylammonium chloride, laurylbetaine, stearylbetaine, lauryldimethylamine oxide, laurylcarboxymethylhydroxyethylimidazoliniumbetaine, silicone surface active agents, fluorine surface active agents, etc. There can also be used surface active agents which have both of a nonionic portion and a anionic portion in one molecule, and surface active agents which have both of a nonionic portion and a cationic portion in one molecule.

The organic pigment and/or the organic dye can be used in the range of 60 to 0.1 wt % in the toner.

The preparation of the toner of this invention can be made by aggregating a mixture of the above polymer particles (primary particles) with the surface-treated organic pigment and/or organic dye and optionally a charge control agent, a mold releasing agent or the like to prepare secondary particles, and further aggregating these secondary particles to form associated particles.

As to the secondary particles constituting the above associated particles, which are the toner of this invention, their form is not limited so long as it does not spoil this invention, but preferably, the secondary particles are those wherein the primary particles of the polymer and the colorant particles are aggregated by bonding strengths such as ionic bond, hydrogen bond, metal bond and weak acid-weak base bond.

Further as to the above associated particles, their aggregation form is not particularly limited so long as the polymer particles and the colorant are aggregated. For formation of the associated particles formed by association of the secondary particles, there can generally be used an association method wherein the ζ-potential is utilized, coacervate, an association method such as interfacial polymerization, a method which comprises heat fusing the interfaces of the secondary particles and then pulverizing the heat fused particles, etc., and among them, the association methods are preferably used.

The mean particle size of the above secondary particles is preferably 0.05 to 12 μm, more preferably 0.2 to 8 μm, particularly preferably 0.5 to 5 μm. Further, the particle size of the associated particles of this invention is preferably 2.5 to 12 μm, more preferably 2.5 to 11 μm.

A preferred process for preparation of the toner of this invention is exemplified as follows.

A pigment and/or a dye or other compouding substances are added to a polymer dispersion obtained by emulsion polymerization and uniformly dispersed therein, and then stirring is continued for 0.5 to 10 hours, preferably 1 to 5 hours and thereby the primary particles of the polymer having polar groups and the surface-treated organic pigment or the like are aggregated to form secondary particles of 1–5 μm in size. When the dispersion is further stirred for 0.5–10 hours, preferably 1–5 hours under heating, aggregation of the secondary particles advances and they grow into associated particles of 1 to 20 μm. The resultant dispersion of the associated particles is stabilized and then heated, and stirring is continued at a temperature higher than the glass transition point of the polymer, preferably a temperature 20° C. or more higher than that for 1 to 12 hours, preferably 1 to 10 hours. Thereby are formed associated particles wherein at least part of the contact portions between the secondary particles in the associated particles make membrances and fuse. The resultant dispersion of the associated particles is dehydrated, washed and dried to give a toner as associated particles. In such associated particles, the secondary particles mutually make a membrane and fuse, and thus they become a toner wherein the secondary particles seldom collapse at the times of storage, transportation, preparation of magnetic developers, etc.

The above preparation method is an example of the association method utilizing the ζ-potential. The ζ-potentials of the polymer particles and the surface-treated pigment particles are lowered in proportion to temperature rise, and as a result aggregation and association of the secondary particles are promoted. As other methods for lowering the ζ-potential, there can be mentioned a method of utilizing control of pH, a method utilizing addition of a metal salt, etc.

The toner of this invention can contain performance-imparting agents such as a fluidizing agent, a life stabilizer and a printing durability improper in such a range that its performance is not impaired, or such performance-imparting agents can be added to the magnetic toner.

As preferred examples of such performance-imparting agents, there can be mentioned metal oxides such as silica, titanium oxide, aluminum oxide, zinc oxide, cerium oxide and magnetite and substances obtained by making these metal oxides hydrophobic; metal salts of higher fatty acids (metal soaps) such as Cd, Mn, Pb, Ba, Ni, Co, Sr, Cu, Mg, Ca, Fe, Al and Zn salts of stearic acid, Cd, Mn, Pb, Ba, Ni, Co, Sr, Cu, Mg, Ca, Fe, Al and Zn salts of oleic acid, Cd, Mn, Pb, Ba, Ni, Co, Sr, Cu, Mg, Ca, Fe, Al and Zn salts of palmitic acid, Cd, Mn, Pb, Ba, Ni, Co, Sr, Cu, Mg, Ca, Fe, Al and Zn salts of linolic acid, Zn and Cd salts of ricinolic acid, Pb salt of caprylic acid, and Pb salt of caproic acid; titanate salts such as barium titanate and strontium titanate; ultrafine powder of acrylic resins; ultrafine powders of fluororesins such as polyvinylidene fluoride resins and ethylene tetrafluoride resins, polyvinylidiene chloride resins, polyvinyl chloride resins, melamine resins, phenol resins, benzoquanamine resins, urea resins, etc.; etc.

The toner of this invention has a low degree of gelation of 2% or less. When the degree of gelation goes beyond 2%, the light transmittance of the toner becomes low and good coloring properties cannot be obtained. The degree of gelation is preferably 1.80% or less, more preferably 1.00% or less, particularly preferably 0.50% or less.

The shape factor S value expressing the shape of the toner of this invention is preferably 100.5 to 160, further preferably 102.0 to 155, more preferably 105.0 to 155, still more preferably 107.0 to 140, particularly preferably 110.0 to 135.

The S value means a shape factor determined by dividing the squared perimeter of the toner particles by the area. Namely, the S value is obtained by processing the plane images of the toner particles by an image processor or the like, calculating the perimeter (PM) and the area (A), and applying the values to the following equation.

$$S\ \text{value}=[(PM)^2\div(4A\pi)]\times 100$$

The S value expresses the feeling of plane unevenness, and in proportion as the shape of the toner particles becomes close to circle (sphere), the value becomes close to 100, and in proportion as the peripheral shape becomes complicated, the value becomes a larger value.

When the S value is smaller than the above lower limit value, the toner particles become close to spheres, and when they are used as a developer, the charge quantity becomes low, the shortage of image density or fog is liable to take place, and in life characteristics, there is a tendency that defective cleaning, etc. occur and the lifetime is shortened.

On the other hand, when the S value becomes larger than the above upper limit value, the state of the surface becomes jagged and becomes an ununiform surface in probability, and thus when the toner particles are used as a developer, the charge quantity remains unstable and the charge quantity distribution becomes uneven and the above-mentioned problems on the images tend to occur, and in life characteristics, there is a tendency that the lifetime is shortened due to occurrence of fine particles, etc.

Further, it is desirable that the relation between the mean rm of the diameters of the toner particles (the mean of 1,000 particles) and the mean rn of the minimal values of the radii of curvature of the surfaces of the particles constituting the toner (the mean of 1,000 particles) is as follows.

$1.01 \leqq v \leqq 320$, wherein $V=rm/rn$ $2.5\ \mu m \leqq rm \leqq 16\ \mu m$ $0.05\ \mu m \leqq rn \leqq rm$ rm and rn are each measured by transmission-type electron photomicrographs.

The V value is preferably 1.01 to 320, more preferably 1.05 to 300, particularly preferably 2.00 to 250. The diameter of the particles of the toner is obtained from the distance between two circumscribed parallel lines.

Further it is preferable that the above toner has a volume mean particle size of 2.5 to 12 μm.

The above S value expresses the feeling of plane unevenness, whereas the V value hereinabove referred to further expresses unevenness sterically. Such feeling of unevenness is due to primary particles of the polymer, particles of the coloring agent, the charge-controlling agent or their secondary particles.

Therefore by processing the plane image of each toner by an image processor or the like, the feeling of the unevenness of the surfaces of the particles can be expressed as a numerical value using the radius of curvature, and it is possible to express the feeling of unevenness of all the toner particles (particularly as associated particles) by deducing the relation of the radius of curvature with the mean particle size of each toner.

When the V value is smaller than the above lower limit, the toner particles are in such a state that their surface state is substantially free of unevenness and smooth and become close to spheres. In the case of such a toner, as stated above, when it is used as a developer, the charge quantity becomes low, and the shortage of image density or occurrence of fog are liable to occur. Further, as to life characteristics, in the system of electrophotography wherein cleaning is made by a cleaning blade, there is a tendency that the hang-up frictional force of the toner against the blade extremely decreases, and defective cleaning, etc. occur and the lifetime is shortened.

On the other hand, when the V value becomes larger than the above upper limit, the unevenness of the toner surface becomes relatively smaller, the behavior pattern closely resembles that in the case where the V value is smaller than the above lower limit. Therefore, not only the above problems easily occur, but in electro-photography of the above system, the hang-up frequency against the blade extremely decreases and defective cleaning easily occurs.

The colored toner obtained by this invention is a colored toner which is excellent in coloring properties due to very good transmittance, is excellent in color reproduction and resolution, exhibits only a small extent of fog and splash, and is excellent in various physical properties.

A developer can be prepared by mixing the toner of this invention with a magnetic carrier. For example, the developer can be prepared by stirring and mixing 20 to 95 weight parts of the magnetic carrier and 5 to 80 weight parts of the toner in a V-type mixer or a ball mill, to charge the toner.

As the magnetic substance, there can be used iron hitherto well known, or ferrite or the like. Further, there can also be used a product obtained by binding fine particles of a ferromagnetic substance using a resin.

As to the particle size of the magnetic substance carrier, the mean particle size is preferably 10 to 200 μm, further preferably 20 to 180 μm, particularly preferably 30 to 170 μm. When the mean particle size goes beyond the above upper limit value, the particles block the space between the doctor blade and the sleeve in control of the magnetic brush of the developer, and therefore it is recommended to use a particle size of ½ or less, preferably ⅕ or less of the doctor gap.

EXAMPLES

Preferred embodiments of this invention are described by the following examples.

(a) Measurement of gel content

ASTM D2765-84 and D3351-74 were referred to.

1 g of a toner is molded at normal temperature using a hydraulic press and a die (press 6.4T/2cm ϕ, 5 min) into a disc tablet having a diameter of 2 cm. The tablet is wrapped in a 400-mesh stainless steel-made wire gauze, and the wire gauze is immersed in acetone reflux for 7 hours. After cooling the wire gauze is taken out, air dried at ordinary temperature for 1 hour and hot air dried at 50° C. for 1 hour, and weighed, and the acetone-insoluble matter is calculated as the gel content according to the following equation.

$$\text{Gel content (\%)} = \frac{W_b b - W_m m}{W_a a} \times 100$$

$W_a$a: weight of the piece molded from the toner $W_b$b: weight of the wire gauze and the residue in the wire gauze after drying $W_m$m: weight of the wire gauze (b) Method for measurement of transmittance An image was printed on an OHP sheet with a toner of monochrome, and transmitted light was measured on the solid portion having an image density ID of 1.0 or more using a color analyzer TC-1800 MK2 produced by Tokyo Denshoku Co., Ltd.

Evaluation was made as follows in accordance with a T value obtained by $$T=(1-Tn/Tm)\times 100$$

Wherein Tm denotes the transmittance percentage at a wavelength of m, and Tn denotes the transmittance percentage at a wavelength of n.

| T | Evaluation |
|---|---|
| 100–85% | ⊙ |
| 85–70% | ○ |
| 70–60% | Δ |
| 60–55% | X |
| 55% or less | XX |

The measuring wavelength was selected as follows.

| | |
|---|---|
| in the case of cyan-color | m = 490 nm<br>n = 615 nm |
| in the case of Magenta color | m = 700 nm<br>n = 540 nm |
| in the case of Yellow color | m = 600 nm<br>n = 415 nm |

(c) Method for evaluation of coloring properties

An image was printed on a paper sheet with the solid portion of a toner of monochrome, and color difference ΔE (NBS unit) was measured by a color analyzer TC-1800 MK2 produced by Tokyo Denshoku Co., Ltd.

As the color standard, a color chart No. 5-1 published by the Electrophotography Society was used.

Evaluation was made as follows in accordance with the color difference ΔE (NBS unit) between the example and the standard.

| ΔE | Evaluation |
|---|---|
| 0–0.5 | ⊙ |
| 0.5–1.5 | ○ |
| 1.5–3.0 | Δ |
| 3.0–6.0 | X |
| 6.0 or more | XX |

(d) Method for evaluation of the density of a copied image

The density of the image (the solid black portion of a test chart N01-R1975 published by the Society of Electrophotography of Japan) was measured using a Macbeth densitometer RD-914.

(e) Fog

Whiteness is measured using a color-difference meter (CR-200) produced by MINOLTA CAMERA CO., Ltdtd.

Color differences L, a and b are measured, and thereby the whiteness of a sheet of paper before copying $$K_o=100-[(100-L)^2+a^2+b^2]^{1/2}$$

and the whiteness of the non-image portion after copying $$K=100-[(100-L)^2+a^2+b^2]^{1/2}$$

are calculated, and fog is calculated therefrom according to the following equation $$\text{Fog(\%)}=K/K_o\times 100$$

The smaller the figure is, the better the fog is, and the fog is judged to be good at 0.5 or less and bad at 1.0 or more.

(f) Resolution

A test chart N01-R1975 published by the Electrophotography Society was copied, the resolving power pattern of 8.0 points was enlarged 100-fold by an optical microscope, and evaluation was made by visual observation according to the following criterion.

5. The thin lines are reproduced, and there is almost no fog between the thin lines.
4. Although the thin lines are reproduced, a small extent of fog is observed between the thin lines.
3. Reproduction of the thin lines is rather bad, and there is a rather large extent of fog between the thin lines.

2. Reproduction of the thin lines is bad, and there is a large extent of fog between the thin lines.

1. The thin lines are not reproduced, and observed as one line.

The larger the figure is, the better the resolution is, and the resolution is judged to be good at 4 or more and bad at 3 or less.

(g) Method for measurement of the S value and the V value

A toner obtained was image processed using LUZEX 3U produced by Nikon Co., Ltd. to determine an S value. At this time, the measured number of the particles was 10,000 and their mean value is expressed by the S value. Further, the electron photomicrographs (10,000-fold) of the toner particles were subjected to the above processor to determine V values, and the mean value of a measured number of 1,000 was expressed by the V value.

(h) Change of particle sizes

A life test (10,000 sheets) was made in the copying test of the examples and the comparative examples, and a comparative value was calculated of the distribution of the number (the number (%) of particles of 5 μm or less) of the toner in the initial developer to the distribution of the number of the toner in the developer after the life test.

| Comparative value | Evaluation |
|---|---|
| 130% or more | Splashes occur and the charge quantity becomes unstable; bad |
| 110% or less | good |

(i) Evaluation by visual observation

The state in the life was observed in the copy life test (10,000 sheets) and evaluation was made. The observation was made on the following items, etc.

(1) Defective cleaning (2) Peeling of the cleaning blade (3) Splash (4) Toner stagnant point/white spot

Example 1

| (Preparation of an acidic polar groups-containing polymerization resin) | |
|---|---|
| Styrene monomer (ST) | 82 parts |
| Butyl acrylate (BA) | 18 parts |
| Acrylic acid (AA) | 5 parts |

The above monomer mixture was added to the following aqueous solution mixture of

| | |
|---|---|
| Water | 100 parts |
| Nonionic emulsifier (Emulgen 950 produced by Kao Corporation) | 1 part |
| Anionic emulsifier (Neogen R produced by Dai-ichi Kogyo Seiyaku Co. Ltd.), | 1.5 parts |

and the mixture was subjected to polymerization at 80° C. for 8 hours under stirring using potassium persulfate as a catalyst to give an acidic polar groups-containing resin emulsion having a solid content of 50%.

| (preparation of a surface-treated organic pigment) | |
|---|---|
| Water | 92 parts |
| C.I. Pigment Red 122 | 8 parts |
| Anionic surface treatment agent 1 (Neogen R produced by Dai-ichi Kogyo Seiyaku Co., Ltd.) | 1 part |
| Anionic surface treatment agent 2 (Sodium salt of β-naphthalene sulfonic acid-formaline condensate; Demol N produced by Kao Corporation) | 2 parts |

The above mixture was held at about 25° C. for 2 hours while dispersed and stirred with a disper to give a mixed liquid of the surface-treated organic pigment.

| (preparation of a toner) | |
|---|---|
| The above acidic polar groups-containing resin emulsion | 200 parts |
| The above organic pigment mixed liquid | 100 parts |
| Water | 250 parts |

The above mixture was held at about 30° C. for 2 hours while dispersed and stirred with a slasher. Then the mixture was heated to 80° C. under stirring and held for 3 hours. Meanwhile observation was made by an optional microscope, and thereby it was confirmed that the particle size of the secondary particles composed of the polymer particles and the organic pigment grew to 1.2μ, and further, the particle size of the associated particles (toner particles) wherein the secondary particles were associated grew to about 6.5 μm. After cooling, the resultant toner was separated by a dispersion centrifuge, washed with water and vacuum dried at 50° C. for 10 hours. The gel content of the resultant toner was measured to be 0.3%. Further, as a result of the image processing of this toner, the S value was 119.5 and the V value was 2.35.

0.8 part of hydrophobic silica was added as a fluidizing agent to 100 parts of the resultant toner, and the mixture was mixed by a Henschel mixer to give a toner for tests.

This toner was mixed with a commercially available ferrite carrier to give a developer for tests having a toner concentration of 3%. This was subjected to a copy test using a commercially available full color copying machine ART-AGE 8000 REALA produced by RICOH COMPANY, LTD., and as a result an image having a high density and a high resolution was obtained. Further, the coloring properties of color was good, and when the image was copied on an OHP sheet, the sheet had very good transparency. The results are shown in Tables 1 and 2.

The mean particle size of the primary particles (particles of the resin emulsion) of the above acidic polar groups-containing polymer was 0.08 μm, the ζ-potential $\zeta P_5$ at pH5 was −21 mV, and the ζ-potential $\zeta P_9$ at pH 9 was −80 mV, and the mean particle size of the above surface-treated organic pigment was 0.2 μm, and the ζ-potential $\zeta P_5$ at pH 5 was −23 mV.

Examples 2 and 3

Toners were obtained in the same manner as in Example 1 except that C.I. Pigment Yellow Y-17 was used in Example 2 in place of the organic pigment of Example 1, and C.I. Pigment Blue B-15:3 was used in Example 3 in place thereof. The toners of Examples 2 and 3 were put in the aforesaid copying machine and subjected to the test to give images excellent in color reproduction. The results are shown in Tables 1 and 2.

Example 4

| (Basic polar groups-containing polymerization resin) | |
|---|---|
| Styrene monomer (ST) | 85 parts |
| Butyl acrylate (BA) | 15 parts |
| Diethylaminoethyl methacrylate (DE) | 5 parts |

The above monomer mixture was added to an aqueous solution mixture of

| | |
|---|---|
| Water | 100 parts |
| Cationic emulsifier (Sanisol B-50 produced by Kao Corporation) | 2 parts |
| Nonionic emulsifier (Emulgen 950 produced by Kao Corporation), | 1.6 parts |

and polymerization was carried out under stirring at 80° C. for 8 hours using an azo polymerization initiator (V-50 produced by Wako Pure Chemical Industries, Ltd.) as a catalyst to give a basic polar groups-containing resin emulsion having a solid content of 50%.

| (Preparation of a surface-treated organic pigment) | |
|---|---|
| Water | 92 parts |
| C.I. Pigment Red 122 | 8 parts |
| Cationic surface treatment agent (Sanisol B-50 produced by Kao Corporation) | 1.5 parts |
| Nonionic surface treatment agent (Emulgen 950 produced by Kao Corporation) | 0.5 part |

The above mixture was held at about 25° C. for 2 hours while dispersed and stirred with a disper, and then the mixture was subjected to dispersion treatment agent by a Gaurin homogenizer to give a mixed liquid of the surface-treated organic pigments.

| (Preparation of a toner) | |
|---|---|
| The above basic polar groups-containing resin emulsion | 200 parts |
| The above surface-treated organic pigments mixed liquid | 100 parts |
| Water | 250 parts |

The above mixture was held at about 30° C. for 5 hours under stirring with a slasher. Then the mixture was heated to 80° C. under stirring and held for 3 hours. Meanwhile the mixture was observed by an optical microscope, whereby it was confirmed that the associated particles of the secondary particles composed of the polymer particles and the organic pigment grew to about 5.2 μm. After cooling, the resultant toner dispersion was subjected to separation by a centrifuge, and the obtained toner was washed with water and vacuum dried at 50° C. for 10 hours.

The gel content of the resultant toner was measured to be 0.2%. 1.2 parts of hydrophobic silica was added as a fluidizing agent to 100 parts of the toner, and the mixture was mixed using a Henschel mixer to give a toner for tests. This toner was mixed with a commercially available ferrite carrier to give a developer for tests having a toner concentration of 5%.

A copying test was carried out using this developer and a commercially available full color copying machine ART-AGE 5330 produced by RICOH COMPANY, LTD., whereby an image having a high density and a high resolution was obtained. Further, the coloring properties of color were good, and when the image was copied on an OHP sheet, the sheet had very good transparency. The results are shown in Tables 1 and 2.

Examples 5 and 6

Toners were obtained in the same manner as in Example 4 except that C.I. Pigment Yellow Y-17 was used in Example 5 in place of the organic pigment of Example 4, and C.I. Pigment Blue B-15:3 was used in Example 6 in place thereof. The toners of Examples 5 and 6 were put in the aforesaid copying machine and subjected to the test to give images excellent in color reproduction. The results are shown in Tables 1 and 2.

Examples 7, 8 and 9

Toners were obtained in the same manners as in Examples 1, 2 and 3, respectively, using

| | |
|---|---|
| Styrene | 90 parts |
| 2-Ethylhexyl acrylate | 10 parts |
| Methacrylic acid | 8 parts |

in place of the polymerization monomer of Example 1. These toners were put in the copying machine of Example 1 and subjected to the test, respectively, whereby image densities excellent in color reproduction and having good transmittance were obtained. The results are shown in Tables 1 and 2.

Example 10

A toner was obtained in the same manner as in Example 1 except that the organic pigment in preparation of the surface-treated organic pigment and dye of Example 1 was replaced by

| | |
|---|---|
| Organic dye C.I. Disperse Red 130 (SRF-46 produced by NIPPON KAYAKU CO., LTD.) | 6 parts |
| Organic pigment C.I. Pigment Red 122 | 2 parts |

This toner was put in the copying machine of Example 1 and tested to give an image having good transmittance. The results are shown in Tables 1 and 2.

Example 11

A toner was obtained in the same manner as in Example 1 except that the organic pigment in preparation of the surface-treated organic pigment and dye of Example 1 was replaced by

| | |
|---|---|
| Organic dye C.I. Disperse Red 130 (SRF-46 produced by NIPPON KAYAKU CO., LTD.), | 8 parts |

and the stirring condition in the preparation of the toner of Example 1 was changed so that the mixture is held at about 30° C. for 5 hours, and then heated to 93° C. and held at that temperature for 5 hours. This toner was put in the copying machine of Example 1 and tested, whereby an image having good transmittance was obtained. The results are shown in Tables 1 and 2.

Comparative example 1

Suspension polymerization was carried out on the same monomer composition as in Example 1 using benzoyl peroxide as a catalyst to give a resin for toners. The organic pigment used in Example 1 was added, without being surface-treated, in the same compounding ratio, to this resin, and the mixture was melted and kneaded, and pulverized by a jet mill to give a toner having a mean particle size of 9.3 μm. The gel content of this toner was 6.5%. A developer was prepared in the same manner as in Example 1 using this toner, and subjected to the same copying test as therein to give an image having bad transmittance and a low resolution. The results are shown in Tables 1 and 2.

Comparative example 2

An acidic polar groups-containing emulsion was obtained in the same manner as in Example 1. A toner was prepared in the same manner as in Example 1 using the organic pigment without surface treatment agent, and subjected to the same copying test as therein. The gel content of this toner was 4.2%. The results are shown in Tables 1 and 2.

Comparative example 3

The toner obtained in Comparative example 1 was subjected to processing for making the particles sherical using a hybridizer (produced by Nara Kikai Co., Ltd.), and a copying test was carried out in the entirely same manner as in Example 1 using this toner. The results are shown in Tables 1 and 2.

TABLE 1

| | | | Image characteristics | | | | | Life particle | |
|---|---|---|---|---|---|---|---|---|---|
| | Toner particle size (μm) | Gel content (%) | Trans-mittance | Coloring properties | Initial image density | Paper fog (%) | Resolu-tion | size change (%) | Life state by visual evaluation |
| Example | | | | | | | | | |
| 1 | 6.5 | 0.3 | ◎ | ○ | 1.34 | 0.25 | 4 | 103 | Nothing particular |
| 2 | 6.4 | 0.15 | ○ | ◎ | 1.43 | 0.20 | 4 | 105 | Nothing particular |
| 3 | 6.5 | 0.35 | ◎ | ◎ | 1.26 | 0.45 | 5 | 101 | Nothing particular |
| 4 | 5.2 | 0.2 | ○ | ○ | 1.44 | 0.40 | 5 | 104 | Nothing particular |
| 5 | 5.5 | 0.45 | ○ | ◎ | 1.46 | 0.45 | 4 | 107 | Nothing particular |
| 6 | 5.3 | 0.2 | ◎ | ◎ | 1.36 | 0.30 | 5 | 101 | Nothing particular |
| 7 | 6.0 | 0.25 | ○ | ◎ | 1.41 | 0.20 | 5 | 109 | Nothing particular |
| 8 | 5.8 | 0.35 | ◎ | ○ | 1.35 | 0.40 | 5 | 108 | Nothing particular |
| 9 | 6.1 | 0.4 | ◎ | ◎ | 1.29 | 0.20 | 5 | 102 | Nothing particular |
| 10 | 5.5 | 0.4 | ◎ | ○ | 1.32 | 0.25 | 5 | 102 | Nothing particular |
| 11 | 5.8 | 0.45 | ◎ | ○ | 1.36 | 0.45 | 5 | 101 | Nothing particular |
| Comparative example | | | | | | | | | |
| 1 | 9.3 | 6.5 | xx | Δ | 1.08 | 1.80 | 1 | 131 | Nothing particular |
| 2 | 6.3 | 4.5 | x | Δ | 1.17 | 0.50 | 4 | 105 | Nothing particular |
| 3 | 9.3 | 6.5 | xx | Δ | 1.19 | 0.70 | 2 | 101 | Defective cleaning occurred |

TABLE 2

| | ζ-Potential (mV) | | | | V value | | |
|---|---|---|---|---|---|---|---|
| | Polymer particles | | Dye and pigment particles | | | | |
| | $\zeta P_5$ | $\zeta P_9$ | $\zeta C_5$ | S value | rm (μm) | rn (μm) | V value |
| Example | | | | | | | |
| 1 | −21 | −80 | −23 | 119.5 | 6.35 | 2.70 | 2.35 |
| 2 | " | " | −32 | 129.2 | 6.28 | 1.53 | 4.10 |
| 3 | " | " | −48 | 124.1 | 6.40 | 2.08 | 3.08 |
| 4 | +69 ($\zeta P_4$) | +10 ($\zeta P_8$) | +59 | 126.5 | 5.10 | 0.69 | 7.39 |
| 5 | +69 ($\zeta P_4$) | +10 ($\zeta P_8$) | +35 | 132.1 | 5.35 | 0.06 | 89.2 |
| 6 | +69 ($\zeta P_4$) | +10 ($\zeta P_8$) | +28 | 122.4 | 5.15 | 1.60 | 3.22 |
| 7 | −32 | −83 | −23 | 138.3 | 5.80 | 0.07 | 82.9 |
| 8 | " | " | −32 | 147.7 | 5.75 | 0.05 | 115.0 |
| 9 | " | " | −48 | 140.5 | 5.88 | 0.09 | 65.3 |
| 10 | −21 | −80 | −26 | 123.1 | 5.30 | 2.48 | 2.14 |
| 11 | −21 | −80 | −12 | 118.6 | 5.75 | 2.95 | 1.95 |
| Comparative example | | | | | | | |
| 1 | — | — | — | 182.6 | 7.25 | 0.02 | 362.5 |
| 2 | −21 | −80 | +0.5 | 120.5 | 5.95 | 1.91 | 3.12 |
| 3 | — | — | — | 100.2 | 7.20 | 7.20 | 1.00 |

We claim:

1. A colored toner for developing electrostatic images which has a degree of gelation of 2.0% or less and comprises an association of secondary particles containing polymer particles having acidic polar groups or basic polar groups and an organic pigment and/or an organic dye treated with a surface active agent which has the same ionic character as the polymer particles so that the absolute value of ζ-potential in the state of aqueous dispersion at pH 5 becomes 10 to 100 mV.

2. The colored toner for developing electrostatic images according to claim 1 wherein the shape factor S value of the toner particles is 100.5 to 160.0.

3. The colored toner for developing electrostatic images according to claim 1 or 2 wherein when the mean diameter of the toner particles obtained from the distance between circumscribed parallel lines is expressed as rm, the mean minimal value of the radius of curvature, on the surface of the toner particles, of each associated particle constituting the toner is expressed as rn, and V is assumed to be rm/rn, V, rm and rn have the following values:

$1.01 \leqq V \leqq 320$ $2.5\ \mu m \leqq rm \leqq 16\ \mu m$ $0.05\ \mu m \leqq rn < rm$.

4. A developer for electrostatic images which comprises the colored toner of claim 1 or claim 2 for developing electrostatic images and a carrier.

5. A colored toner for developing electrostatic images which has a degree of gelation of 2.0% or less and comprises an association of secondary particles, wherein said secondary particles comprise an aggregation of a mixture of (1) primary polymer particles of polymer having acidic polar groups or basic polar groups and (2) an organic colorant selected from the group consisting of organic pigment, organic dye and mixture thereof; wherein said organic colorant has been contacted with a surface active agent selected from the group consisting of (i) anionic surface active agents and dispersants, (ii) nonionic surface active agents and dispersants, and (iii) cationic surface active agents and dispersants, said agent having the same ionic character as that of the primary polymer particles, such that the absolute value of ζ-potential in an aqueous dispersion at pH 5 becomes 10 to 100 mV.

6. A colored toner according to claim 5 wherein said toner has a degree of gelation of no more than 0.50%.

7. A colored toner according to claim 5 wherein said association of secondary particles has a shape factor S of from 100.5 to 160.0.

8. A colored toner according to claim 5 wherein said association of secondary particles has a shape factor S of from 105.0 to 155.

9. A colored toner according to claim 5 which comprises from about 40 to 99.9% by weight of primary polymer particles and from about 60 to 0.1% by weight of organic colorant.

10. A colored toner according to claim 5 wherein the mean particle size of the primary polymer particles is from 0.01 to 10 μm, the mean particle size of the secondary particles is from 0.05 to 12 μm, and the particle size of the associated particles is from 2.5 to 12 μm.

11. A colored toner according to claim 5 wherein the mean particle size of the primary polymer particles is from 0.01 to 5 μm; the mean particle size of the secondary particles is from 0.2 to 8 μm; and the particle size of the associated particles is from 2.5 to 11 μm.

12. A colored toner according to claim 1 or claim 5 wherein the surface active agent is selected from the group consisting of mixed fatty acid sodium or potassium soaps, semi-hardened beef tallow fatty acid sodium or potassium soaps, sodium stearate soap, potassium oleate soap, castor oil potassium soap, lauryl sulfate sodium, potassium, ammonium or triethanolamine salt, sodium higher alcohol sulfate salts, sodium dodecylbenzenesulfonate, sodium or potassium alkylnaphthalenesulfonate, sodium or potassium dialkylsulfonesuccinate, sodium alkyl diphenyl ether disulfonate, sodium alkyl diphenyl ether disulfonate, alkyl phosphate diethanolamine salts or potassium salts, polyoxyethylene lauryl ether sulfate sodium or triethanolamine salts, polyoxyethylene alkylphenyl ether sulfate sodium salts, sodium alkanesulfonates, sodium salts of aromatic sulfonic acid-formalin condensates, polycarboxylic acid type high molecular surface active agents, anionic silicone surface active agents, anionic fluorine surface active agents, polyoxyethylene lauryl ethers, polyoxyethylene cetyl ethers, polyoxyethylene stearyl ethers, polyoxyethylene oleyl ethers, polyoxyethylene higher alcohol ethers, polyoxyethylene octylphenylethers, polyoxyethylene nonylphenyl ethers, oxyethylene-oxypropylene block copolymers, sorbitan monolaurylate or monopalmitate or monostearate or tristearate or monooleate or trioleate or sesquioleate or distearate, polyoxyethylenesorbitan monolaurylate or monopalmitate or monostearate or tristearate or monooleate or trioleate or sesquioleate or distearate, nonionic silicone surface active agents, nonionic fluorine surface active agents, tetraoleic acid polyoxyethylenesorbitol esters, coconut amine acetate, stearylamine acetate, coconut amine hydrochloride, stearylamine hydrochloride, stearylamine oleate, lauryltrimethylammonium chloride, stearyltrimethylammonium chloride, distearyldimethylammonium chloride, alkylbenzyldimethylammonium chloride, laurylbetaine, stearylbetaine, lauryldimethylamine oxide, laurylcarboxymethylhydroxyethylimidazoliniumbetaine, cationic silicone surface active agents, and cationic fluorine surface active agents.

* * * * *